United States Patent [19]

Ishizuka et al.

[11] 4,011,714

[45] Mar. 15, 1977

[54] DEVICE FOR MAINTAINING THE OSCILLATION OF A BALANCE FOR A TIMEPIECE

[75] Inventors: Tsutomu Ishizuka, Noda; Seiji Ichikawa, Aizuwakamatsu, both of Japan

[73] Assignee: Rhythm Watch Co. Ltd.

[22] Filed: Mar. 17, 1975

[21] Appl. No.: 558,857

[30] Foreign Application Priority Data

Mar. 19, 1974 Japan ..... 49-30827[U]
Aug. 30, 1974 Japan ..... 49-103307[U]

[52] U.S. Cl. ..... 58/28 R; 58/23A; 331/116 M

[51] Int. Cl.[2] ..... G04C 3/04

[58] Field of Search ..... 58/23 R, 23 A, 28 R, 58/28 A, 28 B; 331/113 R, 116 M, 154; 318/119, 125, 126, 132, 133

[56] References Cited

UNITED STATES PATENTS

| | | | |
|---|---|---|---|
| 3,238,431 | 3/1966 | Raval | 58/28 R X |
| 3,365,635 | 1/1968 | Shelley | 58/23 AC X |
| 3,646,750 | 3/1972 | Reich | 58/28 A |
| 3,718,870 | 2/1973 | Keller | 58/23 AC X |
| 3,759,028 | 9/1973 | Tsuruishi | 58/28 A |

FOREIGN PATENTS OR APPLICATIONS

| | | | |
|---|---|---|---|
| 1,931,507 | 1/1970 | Germany | 58/28 R |

*Primary Examiner*—Ulysses Weldon
*Attorney, Agent, or Firm*—McGlew and Tuttle

[57] ABSTRACT

The device comprises a balance having two magnets attached thereto, a coil combining pick-up and driving functions, two complementary transistors, an RC circuit formed of a speed-up first condenser and a first resistor, a biasing second resistor, a coupling second condenser a third resistor and a third condenser. This device is capable of operating over a wide temperature range, is less influenced by the deviation generally seen in the commercially available transistors, is simplified in construction, is inexpensive to manufacture and is adapted for mass production.

4 Claims, 11 Drawing Figures

DEVICE FOR MAINTAINING THE OSCILLATION OF A BALANCE FOR A TIMEPIECE

BACKGROUND OF THE INVENTION

The present invention relates to a device for maintaining the oscillation of a balance for a timepiece, comprising a balance having two magnets attached thereto, two complementary transistors constituting an astable multivibrator, and a coil coupled as a load to the astable multivibrator and combining pick-up and driving functions.

Several devices of this type are already known, notably from Swiss Pat. No. 347,783, French Pat. No. 2,000,706 and British Pat. No. 1,270,037. However, in the device of the Swiss Patent it has been experienced that this device does not completely achieve its object unless it operates at a substantially constant temperature, which is not generally the case. In the device of the French Patent, the time constant of the RC circuit connected parallel to the emitter of the control transistor thereof cannot be too high, because otherwise the condenser in the RC circuit will be charged increasingly by the emitter current of the control transistor, resulting in the both the value of the emitter resistor in the RC circuit and also its protective effect being restricted. Further, the device of the British Patent is complex in structure and cannot be made into a small-size, so that it is unsuitable for industrial mass production.

The present invention obviates the foregoing disadvantages of the known devices of this type and provide a new, improved device for maintaining the oscillation of a balance for a timepiece.

SUMMARY OF THE INVENTION

According to the present invention, a device for maintaining the oscillation of a balance for a timepiece is provided, which comprises a rotatably mounted balance wheel formed of two discs, respective permanent magnets secured on the discs with poles of respective opposite polarities facing each other, a coil or winding electromagnetically coupled to the magnets and combining pick-up and driving functions, and first and second complementary transistors. The collector of the first transistor is connected to the base of the second transistor through an R.C. circuit consisting of a speedup first condenser and a first resistor connected in parallel. The base of the first transistor is connected, on the one hand, to one terminal of a second resistor and, on the other hand, to one terminal of a second condenser. The other terminal of the second resistor preferably is connected to one terminal of a D.C. power source through a third resistor, and to a point intermediate the emitter of the second transistor and one terminal of a third condenser, respectively. The other terminal of the second condenser is connected to a point intermediate one terminal of the coil or winding and the other terminal of the third condenser, and to the collector of the second transistor, respectively. The emitter of the first transistor is connected, on the one hand, to the other terminal of the source and, on the other hand, to the other terminal of the coil or winding.

An object of the present invention is accordingly to provide a device for maintaining the oscillation of a balance for a timepiece capable of operating over a wide temperature range, such as from 40° C to 80° C, and of minimizing the power consumption during the steady oscillation of the balance.

Another object of the invention is to provide a device for maintaining the oscillation of a balance for a timepiece which is less influenced by the deviation generally characteristic of commercial transistors on the market.

Still another object of the invention is to provide a device for maintaining the oscillation of a balance for a timepiece which is simplified in construction, inexpensive to manufacture, and adapted for mass production.

BRIEF DESCRIPTION OF THE DRAWINGS

Other objects, features and advantages of the present invention will become apparent from the following detailed description referring to the accompanying drawings, in which:

FIG. 3 and FIG. 4 show wave forms explanatory of the voltage or current at the sections of the circuit in the device of FIG. 1, when such sections of the circuit are operating, in each of the wave forms the time $t$ being taken on the horizontal axis and the voltage V or current I being taken on the vertical axis; i.e., more particularly.

DESCRIPTION OF THE PREFERRED EMBODIMENT

Figure 1:
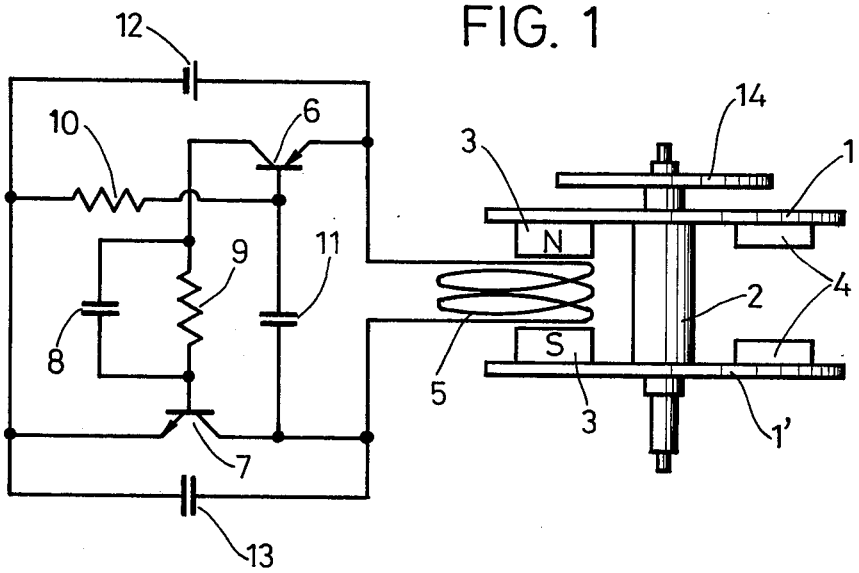
FIG. 1 shows diagrammatically an embodiment of the device for maintaining the oscillation of a balance of a timepiece which is analogous to the preferred embodiment of the present invention but differs therefrom only in that it does not include the third resistor.
Figure 2:
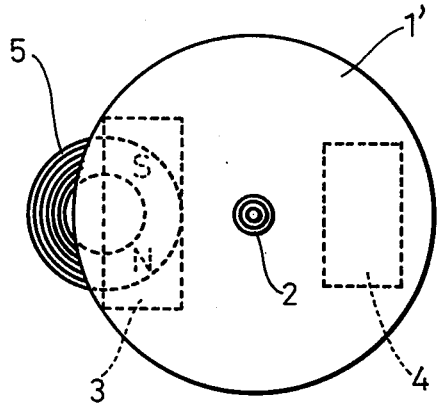
FIG. 2 is a schematic base view of the balance in the device of FIG. 1.

Referring specially to FIGS. 1 and 2 vertically or axially spaced, the balance 1 consists of two disks 1, 1′ secured on a rotatable center shaft 2, and two rectangle-shaped permanent magnets 3, 3 are mounted respectively on the upper and under surfaces of the disks, the magnets 3 being polarized oppositely and the respective different poles of the magnets 3, 3 being opposite with each other. Balance-weights 4, 4 are fixed on disks 1, 1′ respectively, so as to function as a counterbalance.

A ring-shaped coil 5, combining pick-up and driving functions is disposed parallel to the planes of the disks 1, 1' and between the permanent magnets 3, 3, so as to be coupled electromagnetically with magnets 3, 3. That is, coil 5 converts an electric current applied thereto into a mechanical motion of the balance 1 and, at the same time, picks up the mechanical motion of the balance 1 and converts the same into an electric signal.

The circuit in the device illustrated in FIG. 1 comprises two complementary transistors, the collector of one of which transistors, i.e., the PNP transistor 6, is connected to the base of the other transistor, i.e., the NPN transistor 7, through an RC circuit consisting of a speed-up first condenser 8 and a first resistor 9 connected in parallel. The base of the PNP transistor 6 is connected, on the one hand, to one terminal of a biasing second resistor 10 and, on the other hand, to one terminal of a coupling second condenser 11, the other terminal of resistor 10 being connected to the negative pole of a DC power source 12 and to the emitter of the NPN transistor 7, respectively, while condenser 11 is connected to one terminal of the coil 5 and to the collector of the NPN transistor 7, respectively. The emitter of the PNP transistor 6 is connected, on the one hand, to the positive pole of the source 12 and, on the other hand, to the other terminal of coil or winding 5. A third condenser 13 is connected between a point intermediate the collector of NPN transistor 7 and the coil 5 and a point intermediate the emitter of the NPN transistor 7 and the second resistor 10.

Thus, four component loops are formed in the circuit of the above-described device. That is, there are formed a charge loop consisting of the power source 12, coil 5, condenser 11, and resistor 10; an exciting loop consisting of the power source 12, the emitter-collector of the transistor 6, the RC circuit, and the base-emitter of the transistor 7; an oscillating loop consisting of the power source 12, coil 5, and the collector-emitter of the transistor 7; and a discharge loop consisting of the condenser 11, the base-emitter of the transistor 6, power source 12, and the emitter-collector of the transistor 7.

The operation of the device described above will be explained with reference first to FIG. 3A–3D. When the power source 12 is connected to the circuit of the device, a flow of current is established through the charge loop (i.e., source 12 → coil 5 → condenser 11 → resistor 10), whereby the condenser 11 included in this loop becomes charged. As soon as the voltage of the condenser 11 reaches a value over the cut-off voltage of the emitter-to-base circuit of the PNP transistor 6 (cf. *a–b* in FIG. 3A; and *c* in FIG. 3B), this transistor 6 becomes conductive and a current flows through the exciting loop (i.e., source 12 → emitter-collector of the transistor 6 → RC circuit → base-emitter of the transistor 7). At this moment, owing to the function of condenser 8 of the RC circuit included in this loop, the current thus flowing through the exciting loop increases rapidly (cf. *d–e* in FIG. 3C), so as to change the state of the NPN transistor 7 into conduction, and thereby a current flows through the oscillating loop (i.e., source 12 → coil 5 → collector-emitter of the transistor 7).

When the current flows through the coil 5 included in the oscillating loop (cf. *f–g* in FIG. 3D), the balance is driven rapidly counterclockwise or clockwise from the position of equilibrium illustrated in FIG. 2, by the co-operation of the electromagnetic force induced in the coil 5 with the magnetic flux of the permanent magnets 3, 3 secured on the disks 1, 1'. At the same time, the collector-to-emitter voltage of the NPN transistor 7 decreases, so that a current flows through the discharge loop (i.e., condenser 11 → base-emitter of the transistor 6 → source 12 → emitter-collector of the transistor 7). Therefore, condenser 11 included in the discharge loop is rapidly discharged, thus resulting in an OFF state of both the PNP transistor 6 and the NPN transistor 7.

The above-mentioned operation is one cycle of the oscillation of the astable multivibrator of the device. Secondly, in the circuit it follows that a current flows again through the charge loop, to charge the condenser 11 in this loop, and thereby the PNP transistor 6 becomes conductive and the oscillation of the astable multivibrator of the circuit as above-mentioned is repeated.

Figure 4A:
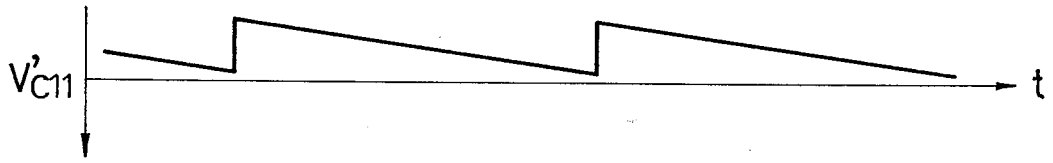
FIG. 4A shows the wave form of the voltage $V'_{C11}$ of the same section of the circuit as in FIG. 3A but while the balance is in steady oscillation.
Figure 4B:
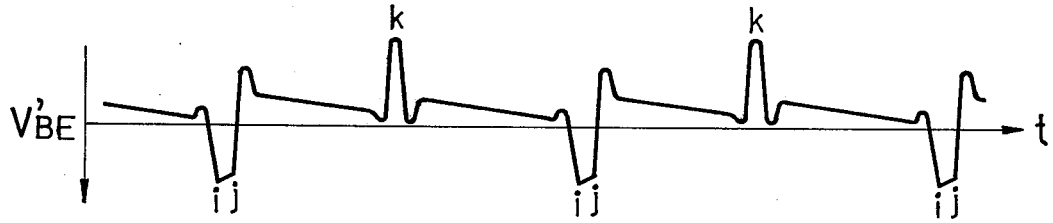
FIG. 4B shows similarly the wave form of the voltage $V'_{BE}$ of the same section of the circuit as in FIG. 3B but while the balance is in steady oscillation.
Figure 4C:
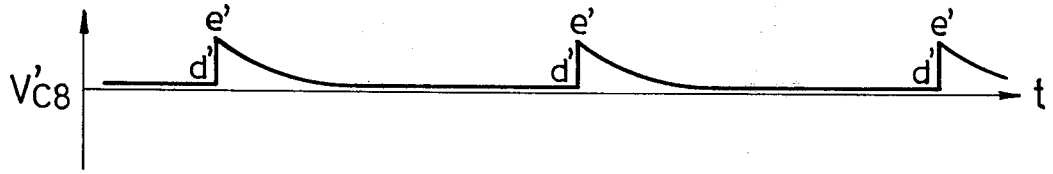
FIG. 4C shows similarly the wave form of the voltage $V'_{C8}$ of the same section of the circuit as in FIG. 3C but while the balance is in steady oscillation.

When the NPN transistor 7 becomes nonconductive, the balance, which has already been driven counterclockwise or clockwise by the (driving) current flowing through the oscillating loop while transistor 7 has the ON state, as described above, is now driven to the opposite direction by the bias of the hair-spring 14 coupled with the balance. An electromotive force is induced in the coil 5 when the balance, thus being driving by the stress of the hair-spring 14, passes over the surfaces of the coil. However, even when this electromotive force has been superimposed on the emitter-to-base voltage of the PNP transistor 6, the state of conduction of this transistor 6 is not changed (cf. *k* in FIG. 4B). On the contrary, another electromotive force is induced in the coil 5 also when the balance passes over coil 5 in the course of its having subsequently been driven by the hair-spring 14 in the direction of the initial driving, and when this other electromotive force is superimposed on the emitter-to-base voltage of the PNP transistor 6 (cf. FIG. 4A; and *i–j* in FIG. 4B), the transistor 6 becomes conductive and a current flows rapidly through the exciting loop (cf. *d'–e'* in FIG. 4C). Hence, the PNP transistor 7 also becomes conductive and a current flows through the oscillating loop including the coil 5, and thereby the balance is driven further in the same direction as that of the initial driving.

When the operation as above-described is repeated, the oscillation amplitude of the balance is gradually increased and the induced voltage in the coil 5, which is superimposed on the emitter-to-base voltage of the PNP transistor 6, also rises, so that the charging and discharging intervals of condenser 11, i.e., the repeating intervals of the ON-OFF state of the transistor 6 are shortened by degrees. This results eventually in a steady (natural) mechanical oscillation of the balance with a constant amplitude and frequency and in the synchronizing of the oscillation frequency of the astable multivibrator in the circuit of the device with the frequency of the natural mechanical oscillation of the balance (cf. T' in FIG. 4D). That is, once the balance has attained a steady mechanical oscillation with a natural frequency, the frequency of the astable oscillation in the circuit is no longer dictated by the time constant of condenser 11 and resistor 10. The duration of the driving current in such a synchronized oscillation is much shorter than that of the starting current (cf. *f–g* in FIG. 3D; and *f'–g'* in FIG. 4D), so that the power loss thereby is reduced to a minimum.

Figure 3A:
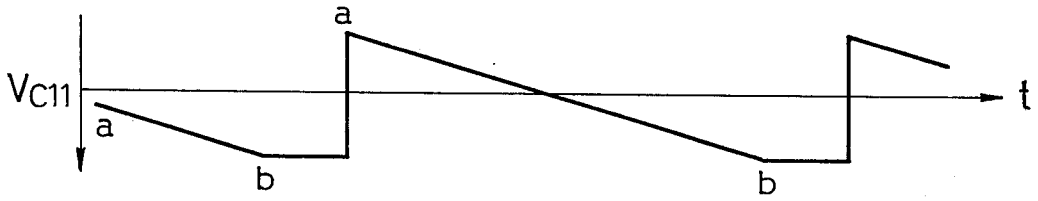
FIG. 3A shows the wave form of the coupling second condenser voltage $V_{C11}$ during the time the balance is not oscillating yet.
Figure 3B:
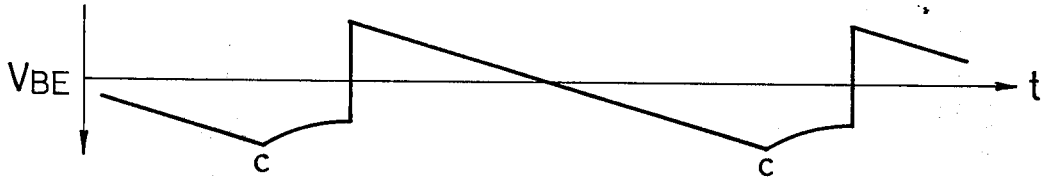
FIG. 3B shows similarly the wave form of the emitter-to-base voltage $V_{EB}$ of the PNP transistor.
Figure 3C:
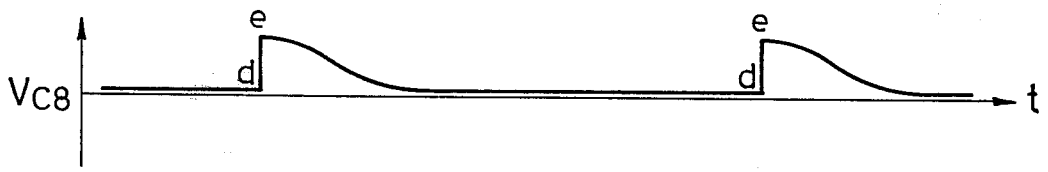
FIG. 3C shows similarly the wave form of the speed-up first condenser voltage $V_{C8}$.
Figure 3D:
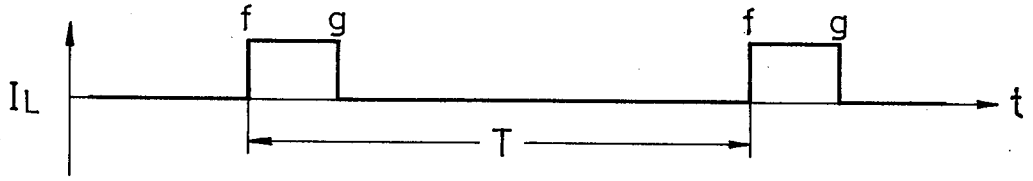
FIG. 3D shows similarly the wave form of the current $I_C$ flowing in series through the coil and the collector of the NPN transistor.
Figure 4D:
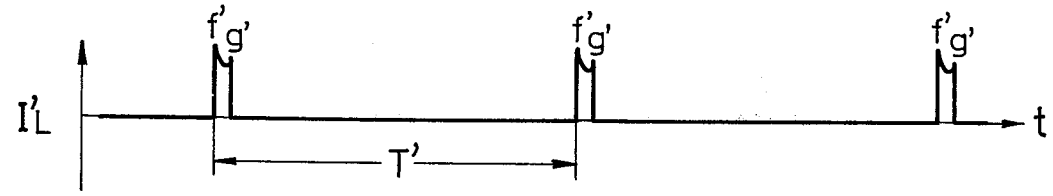
FIG. 4D shows similarly the wave form of the current $I'_C$ at the same section of the circuit as in FIG. 3D, but while the balance is in steady oscillation.

The frequency of the astable oscillation in the circuit as abovementioned is generally set at a frequency greater than the mechanical natural frequency of the balance employed, and the driving current flowing through the oscillating loop is generally set at a value capable of providing a sufficient driving force to effect starting of the balance. The symbol T in FIG. 3D represents such a frequency of the astable oscillation in the circuit while the balance is not oscillating, which frequency is 2–4 times as long as that of the balance, while T in FIG. 4D represents the frequency of the same as synchronized with that of the balance (the scale of the time in FIG. 3D being unequal to that of the time in FIG. 4D).

Figure 5:
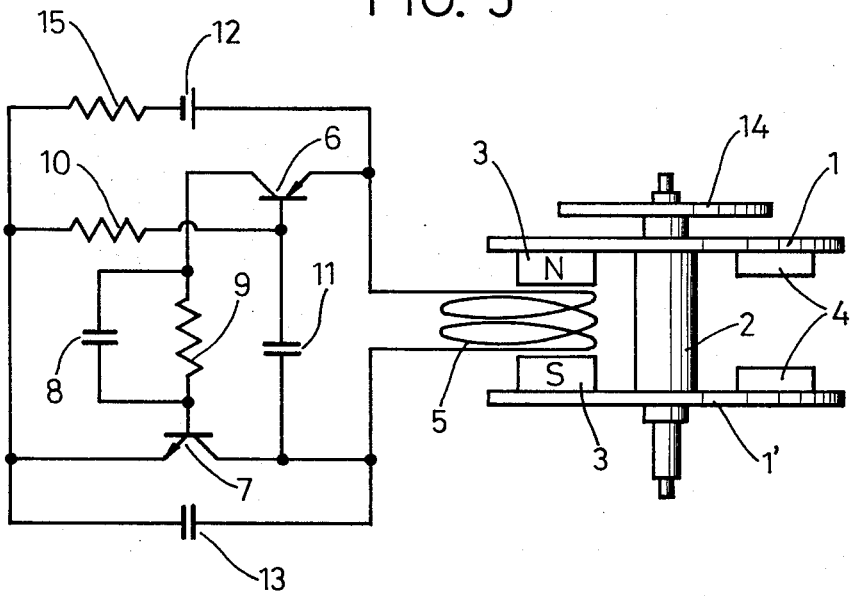
FIG. 5 shows diagrammatically a preferred embodiment of the device of the present invention.

FIG. 5 shows a further embodiment of the device according to the invention, in which a third resistor 15 is connected between the negative terminal of source 12 and a point intermediate resistor 10 and the emitter of NPN transistor 7 illustrated in FIG. 1. In this embodiment, before the balance is oscillating, the voltage drop due to resistor 15 is superimposed on the respective base-emitter input voltages of transistors 6 and 7, so that oscillation of this circuit is stabilized even at high temperatures of 80° C. Further, the voltage drop due to resistor 15 is almost eliminated by the counter-electromotive force induced in the coil 5, while the balance is in steady oscillation (corresponding to *i–j* in FIG. 4B). This means that, in the circuit of FIG. 5, the difference between the duration of the driving current while the balance is not oscillating and the duration of the driving current while the balance is in steady oscillation, is substantially greater than the difference which may be obtained with the circuit illustrated in FIG. 1. By way of example, the ratio between the duration of the current when the balance is not oscillating and the duration of the current when the balance is in steady oscillation may be up to 2–4 in the circuit in FIG. 1, while it may be up to 6–7 in the circuit in FIG. 5.

More particularly, even when the temperature of the device shown in FIG. 5 rises above 50° C, while the balance is in steady oscillation, the stable oscillation of the circuit and the amplitude stabilization are still maintained by reduction of the biasing voltages of transistors 6 and 7 due to the negative feedback effect. In the circuit of FIG. 1, in which there is no resistor 15 in series with the source 12, under the same conditions, maintenance of the stable oscillation and amplitude stabilization cannot be attained. Thus, in the circuit of FIG. 5, the following advantages are even more pronounced, i.e., the rapid attaining of the steady oscillation of the balance, the capability of operating the device over a wide temperature range, the lessened influence of the deviation of commercially available transistors on the market, and the amplitude stabilization of the oscillation of the balance, all of such advantages themselves being true also of the device in FIG. 1.

In the embodiments of the device according to the invention as abovedescribed, as the balance 1 there is adopted a type provided with four poles of magnets 3, 3 facing the coil 5. However, there may be adopted a balance of a type provided with two poles of the magnets facing the coil 5, though in this type of balance the electromotive force induced in the coil drives the balance in both directions, with the result that its power consumption increases as compared with a balance of the four poles-type. The third condenser 13 circuit described in the above is one for preventing parasitic oscillation which might be produced in the circuit of this device. Further, when the above-mentioned two transistors 6, 7 are relocated and the power source is reversed in polarity, there can be obtained other respective embodiments of the present invention. The operation of such embodiments of the invention is entirely the same as that of the device described in the above referring to FIG. 1 to FIG. 4.

What we claim is:

1. A device, for maintaining the oscillation of a balance of a timepiece, comprising, in combination, a rotatably mounted balance wheel formed of two concentric axially spaced discs; two permanent magnets each secured on a respective disc with their poles of respective different polarities facing each other; a stationary coil electromagnetically coupled to said magnets and combining pick-up and driving functions; two complementary transistors, each including a base, a collector and an emitter; a single RC circuit included in said device and connecting the collector of one transistor to the base of the other transistor; said single RC circuit consisting of a first condenser and a first resistor connected in parallel; a second resistor and a second condenser having first terminals connected to the base of said one transistor, and having second terminals; a DC power source, a third resistor having a first terminal connected to one terminal of said power source; the second terminal of said second resistor being connected to the second terminal of said third resistor and to the emitter of said other transistor; the second transistor of said second condenser being connected to one terminal of said coil; and the collector of said other transistor; a third condenser connected between a first junction point, connecting the second terminal of said second resistor to the emitter of said other transistor, and a second junction point, connecting the second terminal of said second condenser to said one terminal of said coil; the emitter of said one transistor being connected to the other terminal of said power source and to the other terminal of said coil.

2. A device as claimed in claim 1, including a hair spring connected to said balance wheel and biasing said balance wheel to rotate in one direction.

3. A device as claimed in claim 1, in which each disc has secured thereto a respective weight counterbalancing the associated permanent magnet thereon.

4. A device as claimed in claim 1, in which said coil is positioned between said two discs for cooperation with said permanent magnets.

* * * * *